US007238065B2

(12) United States Patent
Bremsjö et al.

(10) Patent No.: US 7,238,065 B2
(45) Date of Patent: Jul. 3, 2007

(54) METHOD AND ARRANGEMENT FOR FUNCTION TEST OF A STEERING FOR A PROPELLER DRIVE ON A BOAT

(75) Inventors: Lars Bremsjö, Olofstorp (SE); Patrik Pettersson, Angered (SE)

(73) Assignee: AB Volvo Penta, Gothenburg (SE)

( * ) Notice: Subject to any disclaimer, the term of this patent is extended or adjusted under 35 U.S.C. 154(b) by 0 days.

(21) Appl. No.: 11/553,309

(22) Filed: Oct. 26, 2006

(65) Prior Publication Data

US 2007/0046240 A1 Mar. 1, 2007

Related U.S. Application Data

(63) Continuation of application No. PCT/SE2004/000649, filed on Apr. 26, 2004.

(51) Int. Cl.
*B63H 21/22* (2006.01)

(52) U.S. Cl. ..... 440/1; 440/53

(58) Field of Classification Search ..... 440/1, 440/53

See application file for complete search history.

(56) References Cited

U.S. PATENT DOCUMENTS 4,055,135 A 10/1977 Wesner
4,342,274 A 8/1982 Spurgen et al.
4,624,643 A * 11/1986 Ohlsson et al. ..... 440/2
5,399,112 A 3/1995 Bohlin et al.
5,755,605 A * 5/1998 Asberg ..... 440/75
7,037,150 B2 5/2006 Morvillo

FOREIGN PATENT DOCUMENTS

JP 59202998 A 4/1985
SE 508314 C2 9/1998
SU 501928 A 4/1976

* cited by examiner

*Primary Examiner*—Stephen Avila
(74) *Attorney, Agent, or Firm*—Novak Druce & Quigg, LLP

(57) ABSTRACT

A method and arrangement for function test of steering for a propeller drive on a boat including a propeller drive suspended in a housing that can rotate, a servo motor which is arranged to rotate the rotating housing, a position sensor in association with the servo motor which is arranged to detect an angular position of the rotating housing, a control unit which is arranged to control the servo motor in response to an input signal from a control device corresponding to a required position and an input signal from the position sensor corresponding to an actual position.

14 Claims, 5 Drawing Sheets

METHOD AND ARRANGEMENT FOR FUNCTION TEST OF A STEERING FOR A PROPELLER DRIVE ON A BOAT

CROSS-REFERENCE TO RELATED APPLICATIONS

The present application is a continuation patent application of International Application No. PCT/SE2004/000649 filed 26 Apr. 2004 which is published in English pursuant to Article 21(2) of the Patent Cooperation Treaty. Said application is expressly incorporated herein by reference in its entirety.

FIELD

The present invention relates to a method for function test of steering for a propeller drive on a boat comprising a propeller drive suspended in a housing that can rotate, a servo motor which is arranged to rotate said rotating housing, a position sensor in association with the servo motor which is arranged to detect an angular position of said rotating housing, a control unit which is arranged to control the servo motor in response to an input signal from a control device corresponding to a required position and an input signal from said position sensor corresponding to an actual position. The method thus relates to a function test for a boat that is equipped with a propeller drive that is controlled via an electronic control device.

BACKGROUND

With conventional steering of boats with controllable propeller drives, a mechanical power transmission or mechanical power transmission connected to a hydraulic system is used for power amplification from a wheel to the propeller drive, an example of such a system being given in U.S. Pat. No. 5,399,112. This type of steering is well-suited for boats equipped with one drive, and for boats where the distance between the wheel and actuator for the controllable propeller drive is not such that the laying of cables between the wheel and actuator constitutes a problem. For boats equipped with several drives and for boats where it is not desirable to have mechanical or hydraulic power transmission from the position where the wheel is located to actuators for setting the position of the propeller drives, it is expedient to utilize electronic control of the actuators. This applies in particular for a type of boat which is driven at planing speeds and is designed with a V-bottomed hull designed for planing, with an individually-controllable drive suspended on each side of the center line of the hull. These drives comprise an underwater housing projecting downwards from the outside of the hull, suspended in such way that it can be rotated in relation to the hull. A drive shaft is mounted in the underwater housing in such a way that it can rotate. The drive shaft drives a propeller shaft that is at least essentially horizontal, via a bevel gear mechanism contained in the underwater housing. Such a type of boat is known in, for example, SE-9402272-0. As the drives are suspended at right angles to the bottom of the hull on each side of the center line of the V-shaped hull, the drive shafts will be angled in relation to each other. This means that a mechanical power transmission for steering both drives would be very complex, in particular in the case when individual steering of the drives is required in response to movements of the wheel.

To achieve the abovementioned object, it is advantageous to utilize electronic control of steering for a propeller drive on a boat comprising a propeller drive suspended in a housing that can be rotated.

With the utilization of electronic control systems for boats, it is of the greatest importance that the control systems should be reliable. Incorrect steering can result in unnecessary wear and tear on bearings and other components comprised in the boat's driveline. Incorrect steering can also mean that the boat's maximum performance cannot be utilized, which is the case when a boat equipped with two propeller drives does not correctly set the direction of the propeller drives and hence the direction of the propulsive thrust.

In order to ensure that the steering is correct, it is proposed in US 2003/0079668 that an electronic control system is continually calibrated. Said patent application describes an electronic control system for a boat with waterjet operation. Calibration in association with starting up the vessel, so-called "dockside calibration", is carried out, where all actuators for active steering of the waterjet unit's intake are moved from one end position to the other. At the same time, the helmsman is to move control devices in the form of a wheel and joystick to the respective extreme positions.

Although this type of calibration ensures that the control system is functioning correctly, the calibration is time-consuming and also requires the helmsman's active participation. This means that the helmsman may perceive the calibration as troublesome and as a result may skip the calibration procedure. As the calibration, and hence the function test of the control system, requires something to be carried out by hand, there is also a danger that the helmsman will forget to carry out the calibration.

SUMMARY

An object of the invention is to provide a method for function test of steering for a propeller drive on a boat comprising a propeller drive suspended in a housing that can rotate.

The method utilizes an algorithm where a control unit which is arranged to control a servo motor generates a required position for a rotating housing that supports a propeller drive. The required position is generated without an input signal, corresponding to a movement to said required position, being generated from a control device. The fact that the control device does not need to be activated means that the helmsman does not actively need to carry out any steering during the function test. After the required position has been generated, the control unit activates the servo motor whereupon rotation of the housing to said required position is achieved. The control unit records the input signal from the position sensor whereby the movement of the housing can be recorded and the control unit can verify that the housing assumes the required position. Finally, the control unit records that the steering of the propeller drive is working if the required position is assumed and the control unit records that the steering of the propeller drive is not working if the required position is not assumed.

In a particularly preferred embodiment, the boat comprises, in addition, a safety brake controlled by said control unit, which safety brake is arranged to lock said rotating housing to prevent rotation. In this case, the following additional method steps are preferably carried out: (a) the control unit applies said safety brake during the function test during the movement from an initial position to said required position; (b) the control unit records the input signal from the position sensor in order to verify that the movement of the rotating housing is stopped upon the application of the brake; (c) the control unit releases said safety brake during said function test, whereupon the movement of the rotating housing resumes; (d) the control unit continues to record the input signal from the position sensor in order to verify that the housing assumes said required position, and (e) the control unit records that steering of the propeller drive is working if the required position is assumed and the brake stopped the movement of the housing and the control unit records that steering of the propeller drive is not working if the required position is not assumed or if the brake did not stop the movement of the housing.

By applying the safety brake during the function test and verifying that the brake is working and that the housing finally assumes the correct required position by recording via a position sensor that the rotation of the housing stops and then starts again after the brake has been released from the housing, it is ensured that the steering of the propeller drive is functioning correctly.

According to an embodiment of the invention, the control unit applies said safety brake, whereupon the position of said rotating housing is locked, if the control unit recorded that the steering of the propeller drive is not working.

The brake is preferably of the type where releasing the brake requires active application of force by an actuator, while the brake is applied if the actuator is without current. For example, the brake can be held in a braking position by spring-loading and can be released by means of an actuator that can be in the form of a solenoid. If a fault is found in the steering of the propeller drive, the brake is applied, whereupon the position of the propeller drive cannot be changed. Steering of the boat must then be achieved by other means, for example by a rudder or by steering using other propeller drives on the boat. Even if steering cannot be achieved as efficiently as when the drive can actively assist in the steering, locking of the faulty drive ensures that the steering is predictable.

According to an embodiment of the invention, the required position corresponds to a predetermined starting position for the propeller drive from which normal operation of the propeller drive can commence. This predetermined starting position can advantageously consist of straight forward operation. By normal operation of the propeller drive is meant that power transmission from a propulsion motor arranged in association with the propeller drive can commence, for example by a gearbox arranged between the propulsion motor and propeller drive changing from neutral to a driving gear, corresponding to forward or reverse operation of the propeller drive.

According to yet another embodiment of the invention, the initial position corresponds to a predetermined parking position for the propeller drive, which the propeller drive assumes in association with a propulsion motor arranged in association with the propeller drive being switched off.

A function test is preferably carried out each time after the control unit has been inactive, which can be recorded by the control unit being without current. In this way, it is verified that the control unit's program has been started up correctly upon activation. According to yet another embodiment, a function test is carried out after a propulsion motor arranged in association with the propeller drive has been started and before power transmission between the propulsion motor and propeller drive is engaged. By carrying out the function test after the propulsion motor has been started, it is ensured that a power supply for the servo motor is available, which is normally provided by a generator on the propulsion motor. In addition, the fact that the function test is carried out before the power transmission commences, means that the test has verified the functionality of the propeller drive steering before the boat is put in motion.

BRIEF DESCRIPTION OF THE DRAWINGS

The invention will be described below in greater detail with reference to the attached drawings, in which.

DETAILED DESCRIPTION

Figure 1:
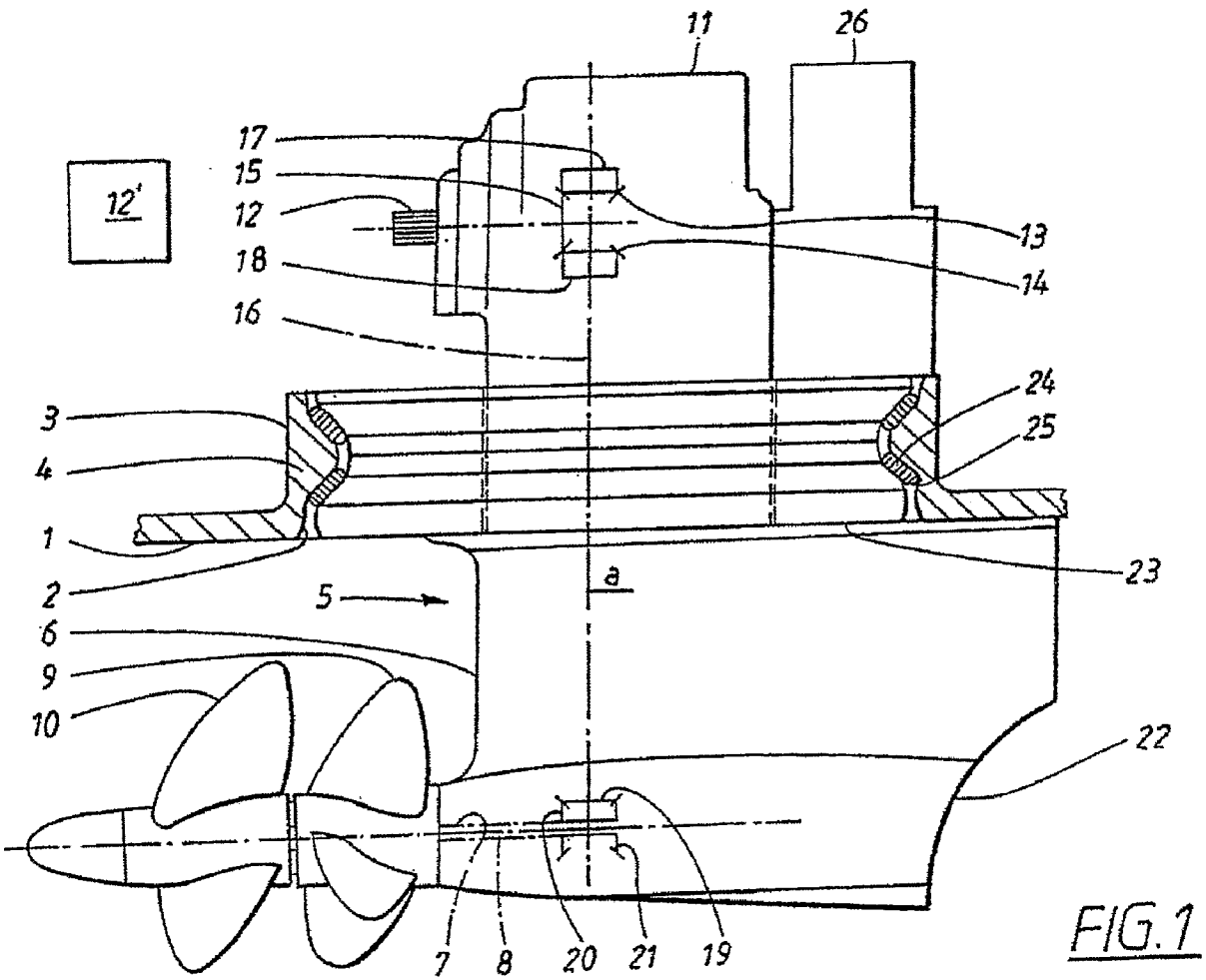
FIG. 1 shows a longitudinal section through a part of a boat bottom equipped with a drive of a type with which the invention can be utilized.

In FIG. 1, the bottom of a boat's hull, designated 1, can consist of molded glass fiber reinforced polyester plastic. The bottom of the hull is designed with an opening 2, which is surrounded by a vertical sleeve 3, which projects up into the interior of the hull. The sleeve is preferably molded in one piece with the bottom 1 and is designed with an internal peripheral flange 4 which, in the embodiment shown, has an essentially triangular cross section.

The sleeve 3 with the flange 4 forms a suspension device for a propeller drive designated in general by 5 which, in the embodiment shown, has an underwater housing 6, in which two concentric propeller shafts 7 and 8, each with a propeller 9 and 10, are mounted in such a way that they can rotate. The underwater housing 6 is connected to a gearbox 11, in which a horizontal drive shaft 12 is mounted in such a way that it can rotate. The shaft 12 is designed to be connected to an outgoing shaft from a motor 12'. The shaft 12 drives a vertical shaft 16 via a bevel gear enclosed in the gear box 11, which bevel gear comprises conical cog wheels 13, 14 and 15. The cog wheels 13 and 14 are mounted on the shaft 16 in such a way that they can rotate or alternatively can be locked on the shaft by means of a multidisc lubricated disc clutch 17 and 18 respectively to drive the shaft 16 in either rotational direction. The shaft 16 drives the propeller shafts 7 and 8 in opposite rotational directions via a bevel gear enclosed in the underwater housing 6 and comprising cog wheels 19, 20 and 21. In the embodiment shown, the propellers 9 and 10 are tractor propellers arranged in front of the underwater housing 6, at the rear end of which there is an outlet 22 for exhaust gases.

The drive 5 is suspended in the opening 2 by means of a suspension element designated in general by 3, which engages around the flange 4 with interlayers consisting of a pair of vibration-suppressing and sealing flexible rings 24 and 25. The underwater housing 6 is mounted in the suspension element 23 in a way that is not described in greater detail so that it rotates around an axis of rotation "a" coinciding with the drive shaft 16. The rotation of the underwater housing 6 is achieved by means of a servomotor 26 that can be an electric motor with a cog wheel fixed on a shaft engaging with a gear ring connected to the underwater housing.

Figure 2:
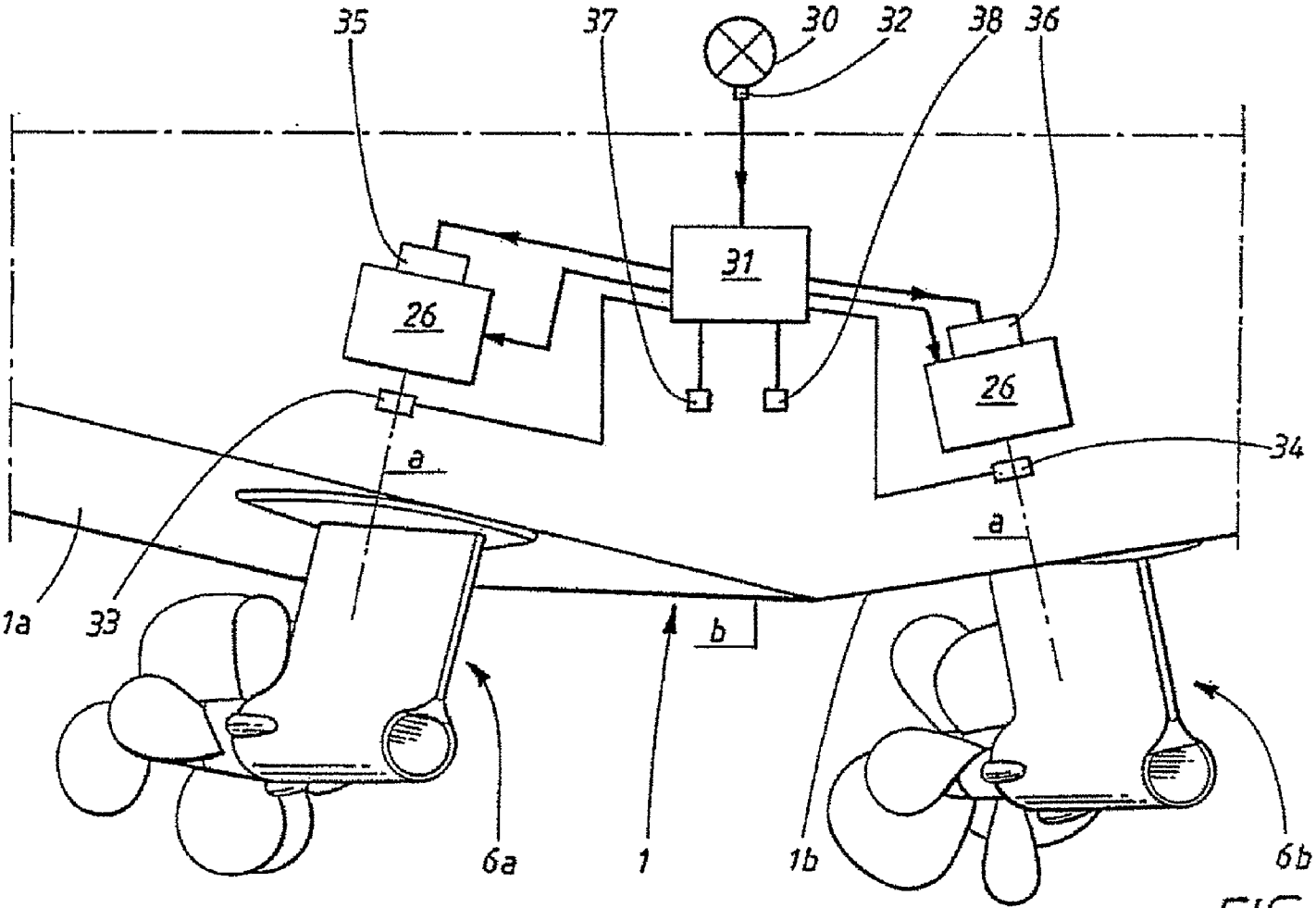
FIG. 2 shows a schematic illustration of the aft section of a boat with two drives of a type with which the invention can be utilized.

FIG. 2 shows the aft section of the hull of a boat with a V-shaped bottom 1. In each bottom section 1*a* and 1*b* respectively and at an equal distance from the center line "b" of the bottom, drives are suspended with underwater housings 6*a* and 6*b* of the type shown in FIG. 1. The underwater housings 6*a* and 6*b* can be suspended in the way that is illustrated in FIG. 1. In FIG. 2, a wheel at a helm is indicated by 30, and 31 is an electronic control unit that can comprise a computer. The control unit 31 is connected electrically to servomotors 26 for each drive. By means of the respective servomotors 26, the drives' underwater housings can be rotated independently of each other around their axes of rotation "a" in response to signals from the control unit 31 for steering the boat.

The wheel 30 is linked with a sensor 32 which detects the movement of the wheel and sends a signal to the control unit 31 in response to the movement of the wheel. In addition, there are position sensors 33 and 34 arranged to detect the angle of rotation of the underwater housings 6*a* and 6*b* around the axes of rotation "a". The position sensors 33 and 34 communicate with the control unit 31. Where appropriate, a control unit can be utilized for each drive 5. In the embodiment shown, a shared control unit is utilized. In addition, a safety brake 35 controlled by said control unit is arranged in association with each servo motor 26. The safety brake is arranged to lock said rotating housing so that it cannot rotate. This can be achieved, for example, by a brake yoke in the brake being brought into engagement with an extension of the rotating underwater housing 6*a*, 6*b* or by a brake yoke in the brake being brought into engagement with the motor or with parts of the transmission between the motor and the rotating housing. The safety brake is preferably designed in such a way that the brake is brought into engagement when an actuator in the brake is inactive. This can be achieved by a spring bringing the brake into engagement and by an actuator releasing the load on the brake when the housing is to be released in order that it can rotate. The actuator can be in the form of a solenoid or alternatively in the form of a pneumatic or hydraulic piston.

In the embodiment shown, signals are also received by the control unit 31 from a tachometer 37 and a log 38 for providing information about whether the boat is being driven below or above its planing threshold. In principle, it is sufficient to have signals from the tachometer 37 or the log 38 for information about the boat's speed. In the control unit 31 various values of the drives' control angles are stored as a function of the movement of the wheel 30 or are calculated on the basis of input data such as, for example, the boat's speed or driving mode.

Figure 3:
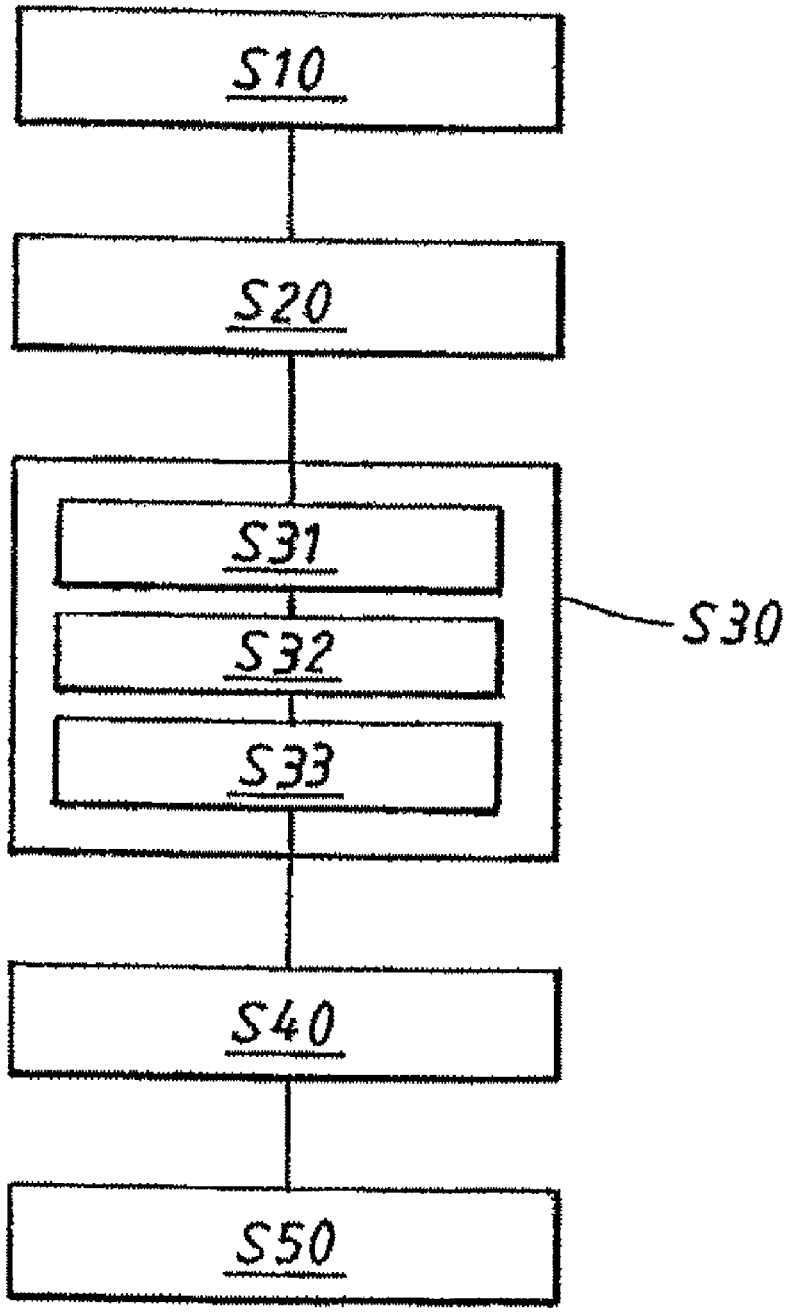
FIG. 3 shows a flow chart for a method for function test of the steering for a propeller drive on a boat according to the invention.

FIG. 3 shows a flow chart for a method for function test of steering for a propeller drive on a boat according to the invention.

In a first method step S10, the control unit generates a required position, without an input signal corresponding to a movement to said required position having been being generated from the control device. The first method step S10 is carried out when the control unit activates its test function. This is carried out preferably in association with the control unit being activated after a period of inactivity. The inactivity can be recorded by the control unit resetting a flag in association with the control unit becoming without current. When the control unit is later started up, it is verified whether the function test has been carried out or not. A reset flag means that the function test is to be carried out whereupon the control unit itself generates a required position, unlike during normal operation when a control device generates an input signal to the control unit, this input signal corresponding to a required position. The required position corresponds preferably to a predetermined starting position for the propeller drive from which normal operation of the propeller drive can be commenced. This position can consist of operation straight forward or can correspond to the position to which the control device was set when the control unit was put into the inactive mode.

In a preferred embodiment of the invention, the function test is carried out after a propulsion motor arranged in association with the propeller drive has been started and before the power transmission between the propulsion motor and the propeller drive has been engaged.

In a second method step S20, the control unit activates the servo motor to rotate the housing to said required position. During this step, the servo motor moves the housing from an initial position towards the required position. The initial position corresponds preferably to a predetermined parking position for the propeller drive, which the propeller drive assumes in association with a propulsion motor arranged in association with the propeller drive being switched off. If a safety brake has been activated, this is released from its engagement with the housing during this step, whereupon the housing is able to rotate freely.

In a third method step S30, the control unit records the input signal from the position sensor in order to verify that the housing assumes said required position. The control unit can be updated in a conventional way at a frequency between 100 and 1000 Hz. Even if the required movement of the housing is so small that it only takes 0.1 seconds, a relatively large number of measurement points are thus obtained, using which the behavior of the system can be studied. The housing is suitably rotated through a limited amount corresponding, for example, to 0.1–10°, preferably 1–2°, which means that the test lasts for 0.1–0.2 seconds. With a sampling frequency of 1000 Hz, 100–200 measurement points are thus obtained. It is also possible to rotate the housing out to both end positions. The test will then be more time-consuming, which could be negative from the point of view of usability.

In a fourth method step S40, the control unit records that the steering of the propeller drive is working if the required position is assumed and the control unit records that the steering of the propeller drive is not working if the required position is not assumed. This can be achieved by the control unit comparing whether the actual position corresponds to the required position when the time for a test window expires.

According to a preferred embodiment of the invention, the control unit applies a safety brake in a method step S31 during the third method step S30 while the housing's position is moved from an initial position to said required position.

At the same time as the movement, the control unit records the input signal from the position sensor during a method step S32, in order to verify that the movement of the rotating housing has been stopped upon the application of the brake.

After the control unit has applied the safety brake during the method step S32, the control unit releases said safety brake in a method step S33, whereupon the movement of the rotating housing is resumed. The control unit continues to record the input signal from the position sensor in order to verify that the housing assumes said required position.

The test for recording that the steering of the propeller drive is working which is carried out during method step S40 is in this case enhanced to comprise monitoring whether the brake was applied and released which is ascertained by verifying that the rotation of the housing has been stopped and resumed during the test. In the fourth method step S40, the control unit records in this case that the steering of a propeller drive is working if the required position is assumed and the brake has stopped the movement of the housing and the control unit records that the steering of a propeller drive is not working if the required position is not assumed or the brake has not stopped the movement of the housing.

In the fifth method step S50, the control unit applies the safety brake, whereupon the position of said rotating housing is locked, if the control unit has recorded that the steering of the propeller drive is not working.

By means of this method step, it can be ensured that steering of the housing is only possible if the control system is working correctly.

Figure 4:
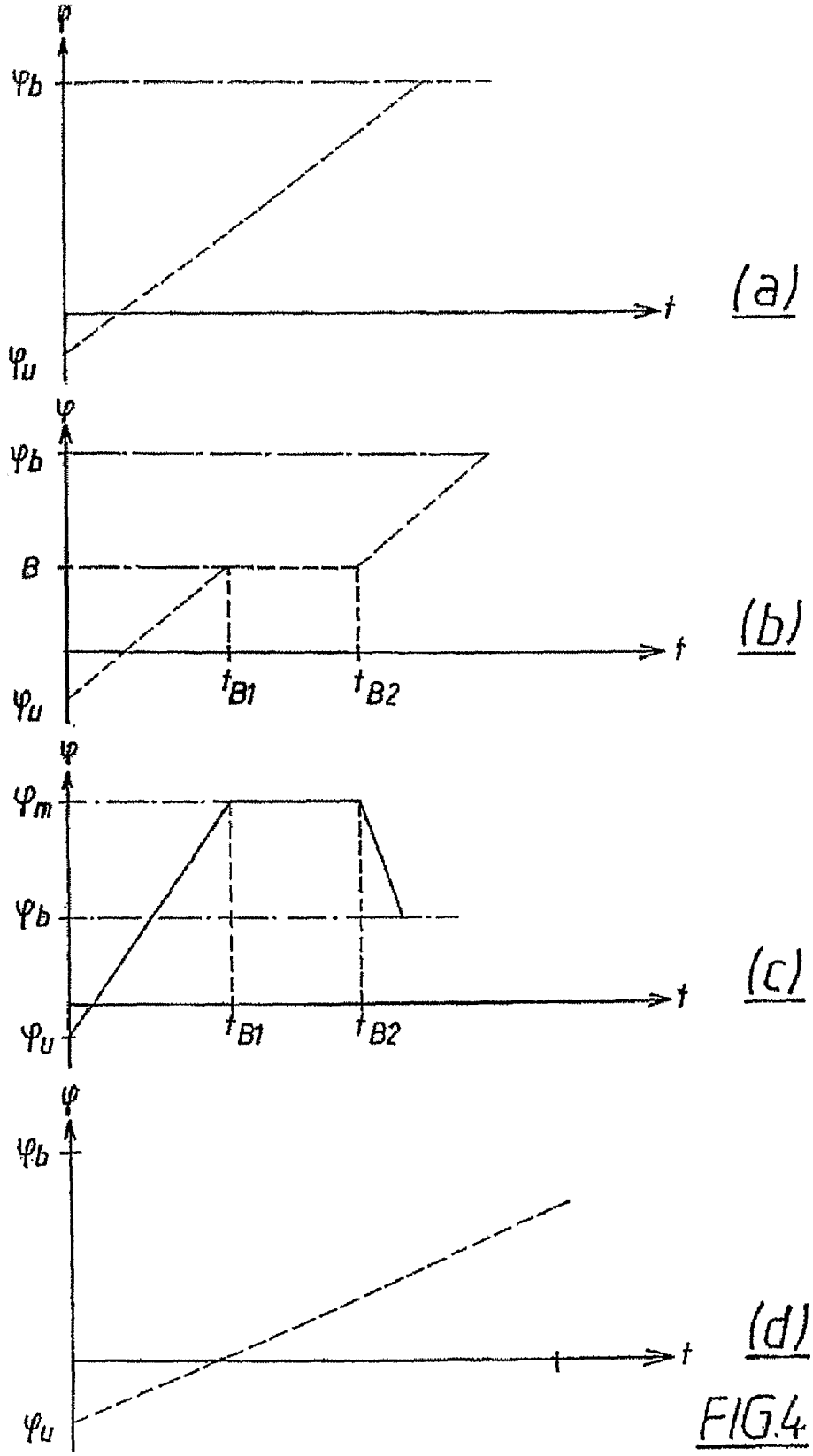
FIG. 4 shows a number of diagrams in which the angle of rotation $\phi$ is indicated as a function of the time t in a time window within which the function test is carried out.
Figure 4:
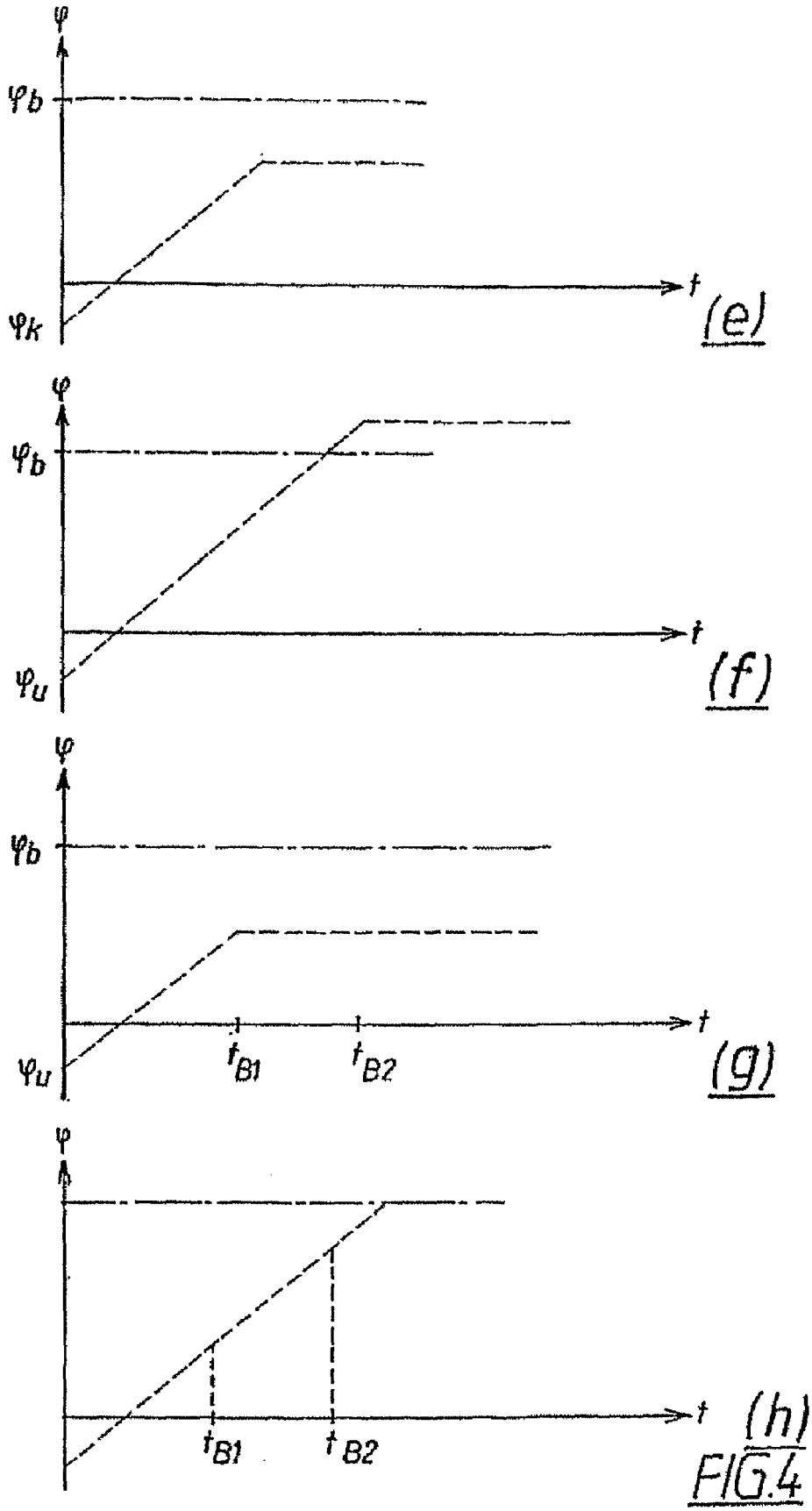

FIG. 4 shows a number of diagrams in which the angle of rotation $\phi$ is indicated as a function of the time t in a time window within which the function test is carried out. The initial position is indicated as $\phi_u$. The required position is indicated as $\phi_b$. FIG. 4*a* shows a test result where the steering of a propeller drive is working and where the safety brake has not been applied. The position sensor has recorded how the housing has been rotated from the initial position $\phi_u$ to the required position $\phi_b$. In addition, the movement takes place at a relatively constant speed. According to an embodiment of the invention, deviation from a constant speed of rotation can be interpreted as a fault arising in the steering of the drive.

FIG. 4*b* shows a test result where the steering of the propeller drive is working and where the safety brake has been applied. The position sensor has recorded how the housing has been rotated from the initial position $\phi_u$ to the required position $\phi_b$.

The safety brake has been applied at the time $t_{B1}$, and released at the time $t_{B2}$.

During the time that the brake was applied, the housing was not moved. According to an embodiment of the invention, the occurrence of rotation during the application of the brake is interpreted as a fault arising in the steering of the drive. In addition, according to an embodiment of the invention, a delay in the application of the brake and/or the releasing of the brake in relation to when the signal is sent to the brake's actuator is interpreted as a fault arising in the steering of the drive.

FIG. 4*c* shows a test result where the steering of the propeller drive is working and where the safety brake has been applied. The position sensor has recorded how the housing has been rotated from the initial position $\phi_u$ via an intermediate position $\phi_m$ to the required position $\phi_b$.

At the intermediate position $\phi_m$, the safety brake has been applied at the time $t_{B1}$ and released at the time $t_{B2}$. During the time that the brake was applied, the housing was not moved. After the brake has been released, the housing moves in an opposite direction back towards the initial position $\phi_u$ to the required position $\phi_b$. The required position ($\phi_b$ can correspond to the starting position for the housing. In this test, it is verified that the steering is correct in both directions and that the brake is activated.

FIGS. 4*d*–4*h* show various examples of test results where the steering of a propeller drive is not working. In FIG. 4*d*, the speed of rotation of the housing is too low, which means that the required position has not been able to be assumed within the maximal time $t_{max}$ for carrying out the function test. In FIG. 4*e*, the rotation has stopped before the housing has been able to assume the required position. In FIG. 4*f*, the rotation has stopped after the housing has been able to pass the required position. In FIG. 4*g*, the brake is applied at the time $t_{B1}$, but is not released afterwards. In FIG. 4*h*, the brake is not applied even though a signal for applying the brake has been sent from the control unit.

What is claimed is:

1. A method for function test of steering for a propeller drive (5) on a boat comprising a propeller drive (5) suspended in a housing (6*a*, 6*b*) that can rotate, a servo motor (26) which is arranged to rotate said rotating housing (6*a*, 6*b*), a position sensor (33, 34) arranged in association with the servo motor (26) which is arranged to detect an angular position of said rotating housing, a control unit (31) which is arranged to control the servo motor (26) in response to an input signal from a control device (30) corresponding to a required position and an input signal from said position sensor (33, 34) corresponding to an actual position, where the method comprises the following method steps:

during said function test, the control unit (31) generates a required position, without an input signal corresponding to a movement to said required position being generated from the control device (S10);

the control unit activates the servo motor to rotate the housing to said required position (S20);

the control unit records the input signal from the position sensor in order to verify that the housing assumes said required position (S30); and the control unit records that steering of the propeller drive is working if the required position is assumed and the control unit records that steering of the propeller drive is not working if the required position is not assumed (S40).

2. The method for function test of setting of a propeller drive according to claim 1, where the boat comprises in addition a safety brake (35, 36) controlled by said control unit, which safety brake is arranged to lock said rotating housing (6*a*, 6*b*) to prevent rotation, characterized in that the following additional method steps are carried out:

the control unit (31) applies said safety brake (35, 36) during said function test during movement from an initial position to said required position (S50), the control unit (31) records the input signal from the position sensor (33, 34) in order to verify that the movement of the rotating housing (6*a*, 6*b*) has stopped upon application of the safety brake (35, 36), the control unit releases said safety brake (35, 36) during said function test, whereupon the movement of the rotating housing (6*a*, 6*b*) is resumed, the control unit (31) continues to record the input signal from the position sensor (33, 34) in order to verify that the housing (6*a*, 6*b*) assumes said required position, and the control unit (31) records that steering of the propeller drive (5) is working if the required position is assumed and the safety brake (35, 36) stopped the movement of the housing (6*a*, 6*b*) and the control unit records that steering of the propeller drive (5) is not working if the required position is not assumed or the safety brake (35, 36) did not stop the movement of the housing (6*a*, 6*b*).

3. The method for function test of setting of a propeller drive according to claim 2, characterized in that the control unit (31) applies said safety brake (35, 36) whereby the position of said rotating housing (6*a*, 6*b*) is locked if the control unit (31) has recorded that the steering of the propeller drive (5) is not working.

4. The method for function test of setting of a propeller drive (5) according to claim 1, characterized in that said required position corresponds to a predetermined starting position for the propeller drive from which normal operation of the propeller drive (5) can be commenced.

5. The method for function test of setting of a propeller drive (5) according to claim 1, characterized in that said initial position corresponds to a predetermined parking position for the propeller drive (5) which the propeller drive (5) assumes in association with a propulsion motor (12') arranged in association with the propeller drive (5) being switched off.

6. The method for function test of setting of a propeller drive (5) according to claim 1, characterized in that said function test is carried out after every time the control unit (31) has been without current.

7. The method for function test of setting of a propeller drive (5) according to claim 1, characterized in that said function test is carried out after a propulsion motor (12') arranged in association with the propeller drive has been started and before power transmission between the propulsion motor (12) and the propeller drive (5) has been engaged.

8. An arrangement for function test of steering for a propeller drive (5) on a boat comprising a propeller drive (5) suspended in a housing (6*a*, 6*b*) that can rotate, a servo motor (26) which is arranged to rotate said rotating housing (6*a*, 6*b*), a position sensor (33, 34) arranged in association with the servo motor (26) which is arranged to detect an angular position of said rotating housing (6*a*, 6*b*), a control unit (31) which is arranged to control the servo motor (26) in response to an input signal from a control device (30, 32) corresponding to a required position and an input signal from said position sensor (33, 34) corresponding to an actual position, characterized in that:

during said function test, the control unit (31) is arranged to generate a required position, without an input signal corresponding to a movement to said required position being generated from the control device (30, 32), the control unit (31) is arranged to activate the servo motor (26) to rotate the housing (6*a*, 6*b*) to said required position, the control unit (31) is arranged to record the input signal from the position sensor (33, 34) in order to verify that the housing (6*a*, 6*b*) assumes said required position, and the control unit (31) is arranged to record that steering of the propeller drive (5) is working if the required position is assumed and the control unit (31) records that steering of the propeller drive (5) is not working if the required position is not assumed.

9. The arrangement for function test of setting of a propeller drive according to claim 8, characterized in that:

the boat comprises, in addition, a safety brake (35, 36) controlled by said control unit, which safety brake is arranged to lock said rotating housing (6*a*, 6*b*) to prevent rotation, the control unit (31) is arranged to apply said safety brake (35, 36) during said function test during movement from an initial position to said required position, the control unit (31) is arranged to record the input signal from the position sensor (33, 34) in order to verify that the movement of the rotating housing (6*a*, 6*b*) has stopped upon application of the safety brake (35, 36), the control unit (31) is arranged to release said safety brake (35, 36) during said function test, whereupon the movement of the rotating housing (6*a*, 6*b*) is resumed, the control unit (31) is arranged to continue to record the input signal from the position sensor (33, 34) in order to verify that the housing assumes said required position, and the control unit (31) is arranged to record that steering of the propeller drive (5) is working if the required position is assumed and the safety brake (35, 36) stopped the movement of the housing (6*a*, 6*b*) and the control unit (31) is arranged to record that steering of the propeller drive (5) is not working if the required position is not assumed or the safety brake (35, 36) did not stop the movement of the housing.

10. The arrangement for function test of setting of a propeller drive according to claim 9, characterized in that the control unit (31) is arranged to apply said safety brake (35, 36) whereby the position of said rotating housing (6*a*, 6*b*) is locked if the control unit (31) has recorded that the steering of the propeller drive is not working.

11. The arrangement for function test of setting of a propeller drive according to claim 8, characterized in that said required position corresponds to a predetermined starting position for the propeller drive (5) from which normal operation of the propeller drive (5) can be commenced.

12. The arrangement for function test of setting of a propeller drive according to claim 8, characterized in that said initial position corresponds to a predetermined parking position for the propeller drive (5) which the propeller drive assumes in association with a propulsion motor (12') arranged in association with the propeller drive being switched off.

13. The arrangement for function test of setting of a propeller drive according to claim 8, characterized in that the control unit (31) is arranged to carry out said function test after every time the control unit (31) has been without current.

14. The arrangement for function test of setting of a propeller drive according to claim 8, characterized in that the control unit (31) is arranged to carry out said function test after a propulsion motor (12') arranged in association with the propeller drive has been started and before power transmission between the propulsion motor (12') and the propeller drive (5) has been engaged.

* * * * *